United States Patent [19]

Parikh

[11] 4,366,593

[45] Jan. 4, 1983

[54] SWEEPER

[75] Inventor: Bhupendra A. Parikh, Parma, Ohio

[73] Assignee: MTD Products Inc., Cleveland, Ohio

[21] Appl. No.: 255,645

[22] Filed: Apr. 20, 1981

[51] Int. Cl.[3] ..... A47L 11/22; E01H 1/04

[52] U.S. Cl. ..... 15/49 C; 15/49 R; 15/79 R

[58] Field of Search ..... 15/49 C, 50 C, 79 R, 15/79 A, 83

[56] References Cited

U.S. PATENT DOCUMENTS

| | | | |
|---|---|---|---|
| 1,043,533 | 11/1912 | Nolan et al. | 15/79 R |
| 4,071,920 | 2/1978 | Block | 15/79 R |

FOREIGN PATENT DOCUMENTS

| | | | |
|---|---|---|---|
| 2845212 | 10/1979 | Fed. Rep. of Germany | 15/79 A |
| 765671 | 1/1957 | United Kingdom | 15/79 R |
| 1127570 | 9/1968 | United Kingdom | 15/79 R |

*Primary Examiner*—Edward L. Roberts

*Attorney, Agent, or Firm*—Woodling, Krost & Rust

[57] ABSTRACT

A sweeping device in which a frame (12) is movable along a floor surface to sweep the same whereby rotary brushes (18) and (20) are rotated by the rolling action of the wheels (25) and (26). The mechanism of the sweeping device is so arranged that the rotary brushes (18) and (20) rotate in opposite directions to sweep dirt or other debris upwardly by the brushes into a receptacle (15).

10 Claims, 5 Drawing Figures

SWEEPER

FIELD TO WHICH INVENTION RELATES

My invention relates to a sweeping device for sweeping up dirt or other debris from a floor surface and for receiving the dirt or debris that has been swept. The sweeper is moved along a floor surface, either indoor or outdoor surfaces, where there is dirt or other debris to be collected. By movement of the sweeper either forwardly or rearwardly, or by a combination of forward and rearward movements, brooms are revolved to sweep up the dirt or debris and to collect it in a receptacle carried by the sweeper. The device includes means for adjusting the heighth of the brushes so as to accommodate for their wear in use. The driving mechanism is such as to give positive rotation to rotary brushes by moving the sweeper back and forth alternately in forward and rearward directions.

BACKGROUND ART OF THE INVENTION

The related art background generally known to the Applicant is a sweeper known as an "absorber" manufactured by Stolzenberg. A photocopy of an advertising circular of that company is being filed herewith.

STATEMENT OF THE INVENTION

It is an object of the invention to provide an efficient device for sweeping a floor surface and for collecting the matter swept by the device by a simple manual movement of the device along the floor surface.

A further object is to provide an improved positive drive between the wheels of a sweeping device and the rotary brushes of the device.

Another object is the provision of a sweeper having rotary brushes combined with means for readily adjusting the heighth of the rotary brushes relative to the plane of the floor surface.

Another object is to improve the operating efficiency of a sweeper having rotary brushes rotated by the rolling of the wheels which support the sweeper as it is moved back and forth.

Other objects and advantages may be observed from the following description of the invention in conjunction with the several drawings.

FIGURES OF THE DRAWINGS

FIG. 5 is an enlarged detailed view showing the mounting of a supporting wheel of the sweeping device on one side of the sweeper, the mounting of the wheel on the other side of the sweeper being similar.

DESCRIPTION OF THE INVENTION

Figure 1:
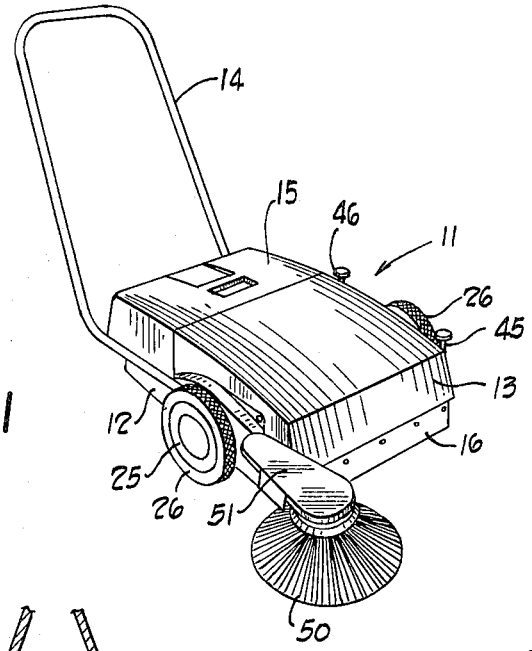
FIG. 1 is a perspective view of my improved sweeping device.

In FIG. 1 the sweeping device is generally denoted by the reference character 11. It has a supporting frame 12 over which is placed and held a cover or housing 13 substantially enclosing the working parts. A two-bar handle 14, as shown, is mounted to the frame 12 and extends upwardly and rearwardly from the rear of the frame. An operator seizes the handle 14 and by pushing and pulling on the handle 14, moves the sweeping device forwardly and rearwardly as desired.

A receptacle 15 is mounted on the frame near the rearward portion of the housing 13 and is disposed to receive and store dirt or other debris swept up by the sweeping device as it is moved along. A flexible skirt or apron 16 carried by the housing 13 is positioned to deflect downwardly any dirt or or debris tending to move forwardly out from under the sweeper. Another skirt or apron 17 is positioned at the rear of the sweeper and extends transversely thereof for deflecting downwardly any dirt or debris tending to escape rearwardly out from under the sweeping device.

A first rotary brush 18 mounted on a shaft 19 is carried by the frame through suitable bearings provided thereon so that the rotary brush 18 extends transversely across the frame from side to side. The brush is of the usual rotary type in that there are tufts or bunches of bristles so mounted as to extend radially outward from the axis of the shaft 19.

A second rotary brush 20 is mounted on a shaft 21 nearer the rear of the sweeper, the shaft 21 being journalled on suitable bearings carried by the frame. The second brush 20 is similar in construction to the first brush 18. The shafts 19 and 21 are disposed on axes parallel to each other and both in generally the same horizontal plane.

Figure 5:
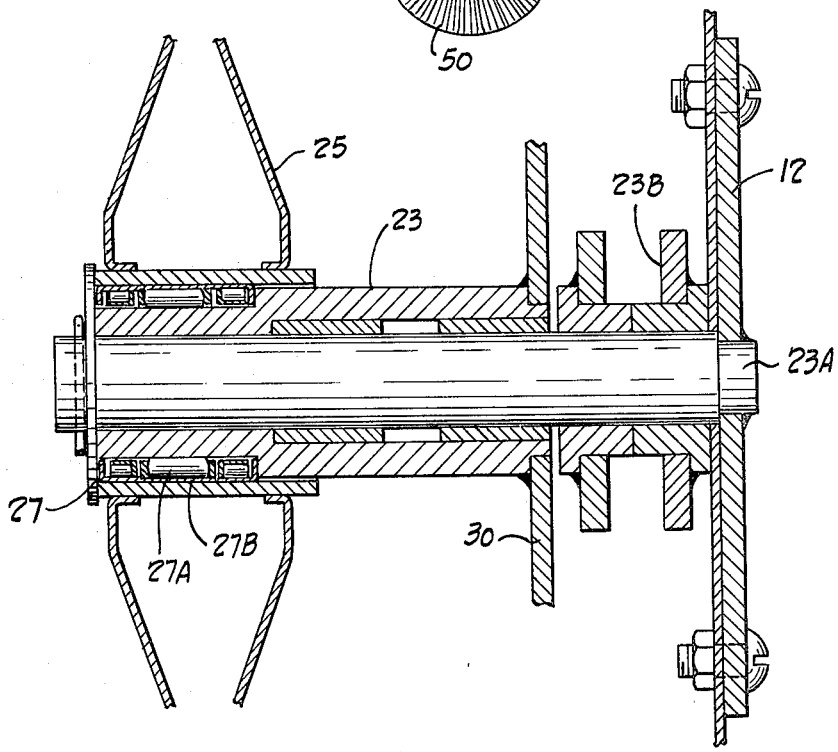
Figure 2:
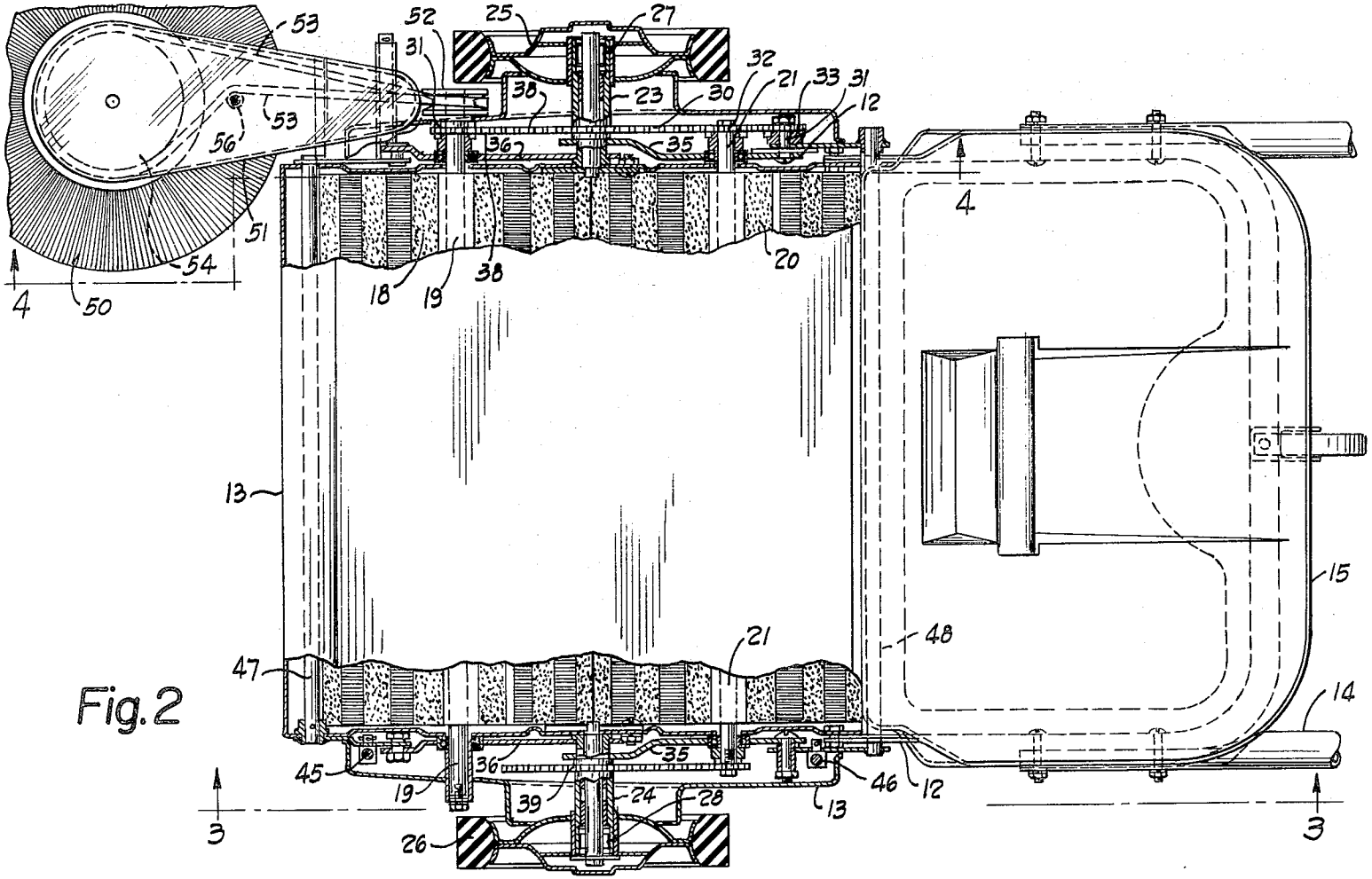
FIG. 2 is a longitudinal sectional view taken in a horizontal plane through my sweeping device and showing the internal mechanism thereof.

The rotary brushes are rotated in opposite directions so that dirt or other debris encountered by the bristles is swept or moved upwardly between the two brushes. The upswept dirt or debris is thrown upwardly against the inside of the housing 13 and is deflected rearwardly to where it falls into the receptacle 15. The bristles of the two rotary brushes are very close to each other and to some degree tend to intermesh as they meet and move upwardly together midway between the axes of the two shafts 19 and 21. On the right side of the sweeping device (shown in the top of FIG. 2) there is a first stub axle 23 which is rotatively mounted on a pintle 23A which as shown in FIG. 5 is securely mounted to, and extends laterally outward from, the frame 12. Also mounted on the pintle 23A between the first axle 23 and the frame 12 is an annular support 23B for purposes to be described. Firmly mounted to the first stub axle 23 is a large sprocket wheel 30 so that the sprocket wheel 30 and axle 23 may rotate in unison. A wheel 25 is mounted by means of a first one-way clutch bearing assembly 27. The one-way clutch bearing assembly 27 is of the type which permits the wheel 25 to revolve around the axle 23 when the wheel revolves in one rotative direction but on the other hand, engages and drivingly connects with the axle 23 when the wheel 25 is rotated in an opposite direction. There are a number of one-way clutch assemblies which are suitable for this purpose but I prefer the one-way clutch bearing embodying needle bearings such as made by The Torrington Company. The bearing assembly 27 contains a plurality of needle bearings 27A positioned in irregularly formed recesses so shaped that the bearings and the wheels thereon freely rotate when the wheel is revolved in one direction, but the bearings move outwardly and lock or engage when the wheel is revolved in another direction. In other words, the assembly is such as to provide "free-wheeling" when the wheel is moved in one direction and provides a driving engagement between the wheel and axle when the wheel is rotated in the opposite direction.

On the opposite side of the frame 12 of the sweeping device and in axial alignment with the first stub axle 23 is a second stub axle 24. It is mounted to the frame 12 which extends outwardly therefrom as illustrated in FIG. 5 except that the two axles 23 and 24 are directed in opposite directions, that is, outboard of the sweeper. Mounted on the second stub axle 24 is a wheel 26 which is also mounted to the axle 24 by a second one-way clutch bearing assembly 28. The first and second one-way clutch assemblies 27 and 28 are similar except that one of them is free-wheeling when the wheel carried thereby moves in one rotative direction and the other one-way clutch assembly is free-wheeling when its respective wheel is rotated in the opposite direction. In other words, when the first wheel 25 is in driving engagement with its respective axle, the other wheel 26 is in free-wheeling position and does not drivingly engage its axle upon which it is mounted. Other than being oriented in opposition to each other, the construction of the one-way clutch assemblies and wheels are similar.

Splined to the brush shaft 19 outwardly of the frame on the right side of the sweeper (at the upper side shown in FIG. 2), is a small sprocket wheel 31 so mounted that the sprocket wheel 31 and shaft 19 rotate together. Splined to the brush shaft 21 on the right side of the sweeper (upper side in FIG. 2), is a small sprocket wheel 32 so that the small sprocket wheel 32 and shaft 21 rotate together. Located rearwardly of the shaft 21 and carried by a stub pin 34 is another small sprocket wheel 33, the small sprocket wheel 33 being free to rotate around the pin 34. A sprocket chain 38 is entrained or enmeshed around and in driving engagement with the large sprocket wheel 30, the small sprocket wheel 31, the small sprocket wheel 32 and the small sprocket wheel 33. It will be noted that the chain is disposed above and over the small sprocket wheel 32 by means of the sprocket wheel 33. This ensures that the sprocket wheels 31 and 32, and therefore the shafts 19 and 21, are rotated in opposite rotational directions as the large sprocket wheel 30 is rotated. The sprocket wheel 33 is idle in that it merely diverts the direction of the chain 39 to provide its opposite rotation of the shafts 19 and 21.

Figure 3:
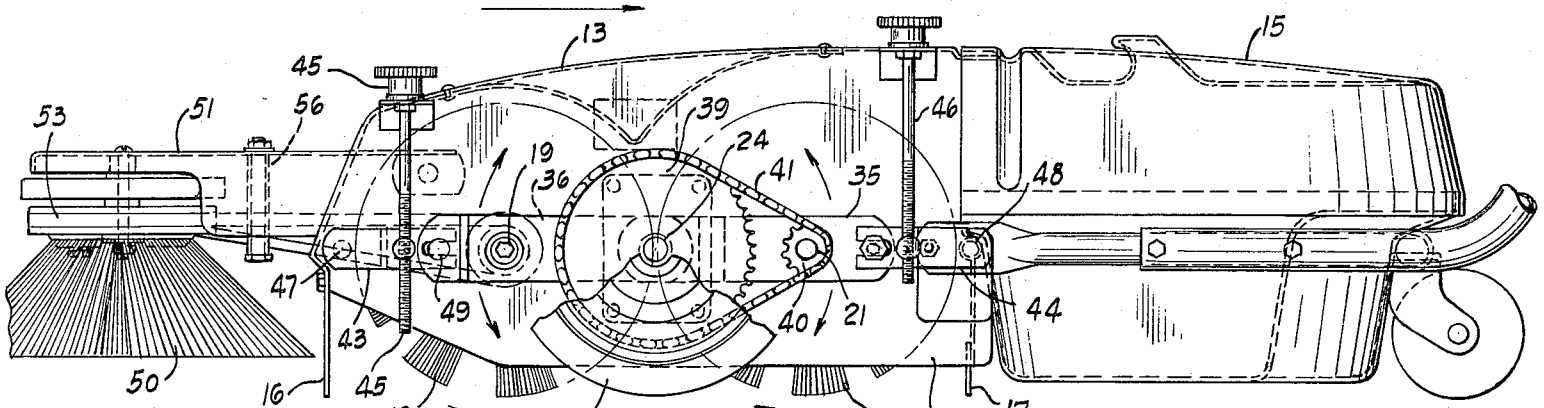
FIG. 3 is a longitudinal sectional view taken in a vertical plane through my sweeping device and taken in the direction of the arrows 3—3 in FIG. 2.
Figure 4:
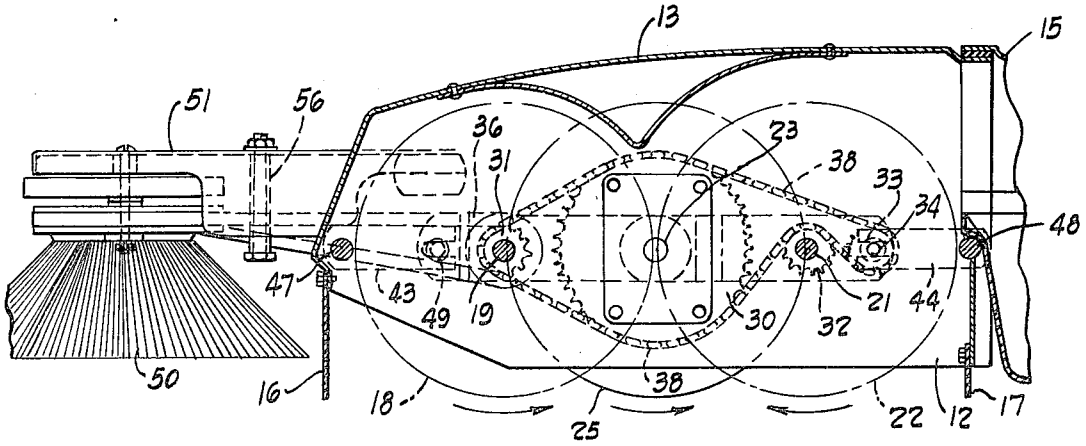
FIG. 4 is a cross-sectional view taken in a vertical plane through my sweeping device and taken through the line 4—4of FIG. 2.

On the left-hand side of the sweeper shown in FIG. 3 (the lower end shown in FIG. 2), there is a large sprocket wheel 39 splined to the stub axle 24. The wheel 26 is mounted to the axle 24 by means of the one-way clutch assembly 28. Rotation of the wheel 26 in one direction rotates the large sprocket wheel 39 as rotation of the wheel 26 in the opposite direction does not drivingly engage the large sprocket wheel 39 and it is then not driven by the wheel 26. Splined to the outer end of the brush shaft 21 at the left side of the sweeper (lower side shown in FIG. 2), is a small sprocket 40. A sprocket chain 41 is enmeshed with and drivingly engages the large sprocket wheel 39 and the small sprocket wheel 40. Rotation of the large sprocket wheel 39 simultaneously rotates the small sprocket wheel 40 and this in turn rotates the shaft 21 which rotates the small sprocket wheel 33 on the other end of the shaft 21. In other words, by means of delivering rotative action through the shaft 21, the sprocket wheels 30, 31 and 32 are drivingly rotated in unison. Thus, all of the brushes are rotated in the desired rotative direction by either rolling movement of one of the wheels or by the rolling movement of the other of the wheels, this alternative rolling of the wheels being obtained by alternately pushing and pulling the sweeping device along the floor surface engaged by the wheels. The shaft 19 is carried in bearing assemblies mounted in brackets 36 on the opposite sides of the frame 12, these brackets extending along the side of and parallel to the frame. The inner end of the bracket 36 has a forked end which engages in the annular support 23B mounted on the pintle 23A carrying the stub axle 23. Similarly the bracket 36 extends along the housing along the opposite side of the sweeper and its inner end also engages in the support provided by the pintle. The support 23B supports the inner end of the bracket and also permits the bracket 36 on each side of the housing to rock or tilt somewhat about the axis of the stub axles. The other end of each bracket 36 is interlocked by a connection 49 with height adjusting arm 43. The connection 49 is such that a hinged or pivotal movement may be obtained between the bracket 36 and arm 43. Some sliding movement is allowed between arm 43 and bracket 36 to accommodate for this swinging movement.

The forward end of the arm 43 is rigidly connected to a pivot rod 47 whereby swinging of the arm 43 is translated into rotation of the rod 47.

On the other side of the sweeper there is a similar arm 43 also rigidly secured to the right-hand end of the rod 47 whereby the arms 43 on both sides of the sweeper swing in unison by reason of the interconnection with the rod 47. The swinging of the arms 43 also swing the bracket 36 upwardly and downwardly in correspondence with the swinging of the arms 43. Thus the bearing carrying the shaft 19 on the brackets 36 disposed on the opposite sides of the sweeper move upwardly and downwardly in correspondence with the movement of the arms 43.

To adjust the position of the arms 43 and to cause them to be swung upwardly or downwardly, an adjusting threaded bolt 45 is provided on one side of the sweeper near its forward end. This bolt 45 is rotatively carried by a bearing on the housing 13 adjacent the upper end of the bolt 45 as indicated. The bolt 45 has a threaded shank which is threadably engaged with a threaded bearing secured to the arm 43 whereby manual rotation of the bolt 45 causes the arm 43 to correspondingly, swing upwardly or downwardly, depending on the rotation of the bolt 45. Thus the rotation of the adjusting bolt 45 changes the elevation of the forward brush 18 relative to the floor surface and so accommodates for wear of the bristles of the brush 18.

Correspondingly, a rear adjusting threaded bolt 46 is carried by the housing near the rearward end thereof and this bolt 46 is threadably engaged with a threaded bearing on a height adjusting arm 44. This height adjusting arm 44 is rigidly secured to a pivot rod 48 extending transversely of the sweeper so as to cause swinging of the arms 44 on opposite sides of the sweeper in unison as the adjusting bolt 46 is rotated. The arms 44 on opposite sides of the sweeper are engaged by means of connections 42 to the brackets 35 on the opposite sides of the sweeper and extending along the sides thereof. The connection 42 is similar to the connection 49 in that some swinging action between the arms 44 and brackets 35 is permitted and some sliding action accommodates for this movement. It is thus seen that rotation of the adjusting bolt 45 moves both ends of the shaft 19, and hence of the brush 18, upwardly and downwardly as desired. Also, rotation of the adjusting bolt 46 moves the shaft 21, and hence the brush 20, upwardly and downwardly as desired. By reason of the pivot rods 47 and 48 extending across the sweeper, it is not necessary to have separate height adjusting means on the opposite sides of the sweeper.

An auxiliary side brush 50 is mounted by means of a supporting arm 51 to the frame 12. A pulley 54 which rotates the brush 50 is drivingly connected by an endless belt 53 to a small pulley 52 on the outer end of the shaft 19 of the first rotary brush. The belt 53 is twisted somewhat so that rotation of the pulley 52 causes rotation of the brush pulley 54 which is oriented on an axis normal to a horizontal plane through the axis of shaft 19. A guide bolt 56 is carried by the supporting arm 51 so as to retain the belt 53 in position.

The mechanism described and shown provides an efficient and easily handled sweeping device for obtaining fast and thorough sweeping of a floor surface by positive and reliable means.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. In a sweeper having a supporting frame adapted to be moved generally parallel to, in alternate forward and rearward directions along a floor surface to be swept, a receptacle carried by the frame for receiving material swept from the floor surface by the sweeper, and a pair of elongated rotary-type brushes mounted on shafts, respectively, carried by the frame and disposed parallel to each other in a plane to be disposed generally parallel to the said floor surface, the combination of a first axle carried by, and extending laterally of, said frame on one side of the frame, a first wheel journalled on said first axle and disposed to be in rolling engagement with said floor surface and to support said frame, a second axle carried by, and extending laterally of said frame on the opposite side of said frame and directed away from said first axle, a second wheel journalled on said second axle and disposed to be in rolling engagement with said floor surface and to support said frame, said first and second axles being disposed on axes transverse of said frame, a first one-way clutch assembly mounted to said first wheel and providing the journal connection between said first wheel and said first axle, the said first one-way clutch assembly being arranged to permit the said first wheel to revolve freely in a rearward direction around the first axle without rotating the said first axle but to engage and drivingly engage the first axle in a forward direction upon the first wheel revolving in a forward direction, a second one-way clutch assembly mounted to said second wheel and providing the journal connection between said second wheel and said second axle, the said second one-way clutch assembly being arranged to permit the second wheel to revolve freely in a forward direction around the second axle without rotating the second axle but to engage and drivingly engage the second axle in a rearward direction upon the second wheel revolving in a rearward direction, a first chain and sprocket drive assembly drivingly connecting the said first axle and the shafts of said brushes to rotate the shafts and brushes carried thereby to rotate the brushes in opposite rotative directions upon the said first axle being rotated in a first direction by said first wheel, a second chain and sprocket assembly drivingly connecting the said second wheel and one of said shafts to rotate both of the shafts, through the said one shaft and the first chain and sprocket assembly, to rotate the brushes in opposite rotative directions upon the second axle being rotated by said second wheel in a second direction, the brushes being rotated in said opposite rotative directions by the alternative movement of the frame in both forward and rearward directions.

2. The combination claimed in claim 1 and including adjusting means carried by the frame for adjusting the level of the shafts of said brushes relative to the floor surface.

3. The combination claimed in claim 1 and including an auxiliary brush carried by the frame rotatively driven to rotate on an axis normal to a plane extending through the axes of the shafts of said rotary brushes, the auxiliary brush being driven by a belt and pulley assembly connecting the auxiliary brush and one of said shafts.

4. The combination claimed in claim 1 and in which said second chain and sprocket assembly includes one of said shafts of the rotary brushes to transmit power therethrough to the first chain and sprocket assembly.

5. The combination claimed in claim 1 and in which the first and second axles are disposed along the same axis transverse of the frame, and in which the shafts of the rotary burshes are disposed parallel to each other in substantially the same plane parallel to a plane passing through the axes of said first and second axles.

6. In a sweeper, the combination of a pair of rotary brushes mounted on parallel shafts in a common horizontal plane, a first wheel on one side of the sweeper, a first chain and sprocket assembly drivingly connecting said first wheel and the shafts of said brushes to rotate the shafts in opposite rotative directions by the rotation of said first wheel in one rotative direction, a second wheel on the opposite side of the sweeper, a second chain and sprocket assembly drivingly connecting the said second wheel and one of said shafts to rotate both of the shafts, through the said one shaft and the first chain and sprocket assembly, in opposite rotative directions, first one-way clutch means mounted to said first wheel operatively between the first wheel and the first chain and sprocket assembly to provide for driving connection between the first wheel and the first chain and sprocket assembly only upon the first wheel being rotated in a first rotative direction, and second one-way clutch means mounted to said second wheel operatively between the second wheel and the second chain and sprocket assembly to provide for driving connection between the second wheel and the second chain and sprocket assembly only upon the second wheel being rotated in a second rotative direction opposite to the said first rotative direction, the arrangement of the wheels, chain and sprocket assemblies, and one-way clutch assemblies providing that upon the sweeper being moved alternately forwardly and rearwardly the said wheels are alternately rotated in opposite directions to concurrently rotate the brush shafts in said opposite directions.

7. The combination claimed in claim 6 and including adjusting means for adjusting the heighth of the brush shafts relative to a floor surface below the brushes for accommodating for wear of the brushes.

8. The combination claimed in claim 6 and in which the said brushes in rotating in opposite directions are moved to sweep upwardly between the brushes to sweep material below the brushes upwardly therebetween.

9. The combination claimed in claim 8 and including a receptacle for receiving material swept upwardly by the rotating brushes.

10. The combination claimed in claim 8 and including an auxiliary brush rotative on an axis disposed normal to a plane passing through the axes of said shafts.

* * * * *